United States Patent [19]

Lancaster

[11] 4,413,463

[45] Nov. 8, 1983

[54] ROLLER STRETCH PASS THROUGH STRETCHING APPARATUS AND PROCESS

[75] Inventor: William G. Lancaster, Louisville, Ky.

[73] Assignee: Lantech, Inc., Louisville, Ky.

[21] Appl. No.: 200,013

[22] Filed: Oct. 23, 1980

[51] Int. Cl.[3] ..... B65B 11/08; B65B 13/04

[52] U.S. Cl. ..... 53/399; 53/441; 53/553; 53/556; 53/586

[58] Field of Search ..... 53/399, 441, 553, 556, 53/586, 466

[56] References Cited

U.S. PATENT DOCUMENTS

| | | | |
|---|---|---|---|
| 2,597,041 | 5/1952 | Stokes | 53/141 |
| 2,757,495 | 8/1956 | Reichel | 156/203 |
| 2,854,697 | 10/1958 | Ryan | 264/25 |
| 2,995,779 | 8/1961 | Winter | 264/210.5 |
| 3,048,895 | 8/1962 | Bottomley | 264/178 R |
| 3,052,917 | 9/1962 | Horn | 264/178 R |
| 3,052,924 | 9/1962 | Ezrin et al. | 264/235.8 |
| 3,068,528 | 12/1962 | Owens | 264/22 |
| 3,097,467 | 7/1963 | Langdon | 53/553 |
| 3,104,937 | 9/1963 | Wyckoff et al. | 264/178 R |
| 3,351,697 | 11/1967 | Hufnagel et al. | 264/288.4 |
| 3,478,142 | 11/1969 | Greene | 264/287 |
| 3,589,091 | 6/1971 | Cloud | 53/441 X |
| 3,596,434 | 8/1971 | Zelnick | 53/556 X |
| 3,608,056 | 9/1971 | Nelson | 264/321 |
| 3,667,664 | 6/1972 | Schroeder | 226/44 |
| 3,672,116 | 6/1972 | Ingmarson | 53/586 X |
| 3,734,994 | 5/1973 | Blecha | 264/288.4 |
| 3,786,127 | 1/1974 | Peet et al. | 264/288.4 |
| 3,796,785 | 3/1974 | Rest et al. | 264/288.4 |
| 3,807,004 | 4/1974 | Anderson | 26/88 |
| 3,816,886 | 6/1974 | Van Cappellen | 26/106 |
| 3,843,761 | 10/1974 | Bierenbaum et al. | 264/154 |
| 3,884,748 | 5/1975 | Anderson et al. | 156/494 |
| 3,896,604 | 7/1975 | Marantz | 53/176 |
| 3,905,533 | 9/1975 | Corse | 226/44 |
| 3,933,569 | 1/1976 | Grasvoll | 53/553 X |
| 3,990,215 | 11/1976 | Elsner | 53/553 |
| 4,014,155 | 3/1977 | Izawa et al. | 53/465 |
| 4,017,227 | 4/1977 | Schmidt | 425/66 |
| 4,069,643 | 1/1978 | Young | 53/556 X |
| 4,076,785 | 2/1978 | Schmidt | 264/146 |
| 4,079,565 | 3/1978 | Lancaster | 53/556 X |

FOREIGN PATENT DOCUMENTS

| | | | |
|---|---|---|---|
| 2422000 | 12/1974 | Fed. Rep. of Germany | 53/553 |
| 2534156 | 2/1977 | Fed. Rep. of Germany | 53/586 |
| 2824381 | 12/1979 | Fed. Rep. of Germany | 53/553 |
| 2281275 | 8/1974 | France | 53/556 |
| 2024760 | 1/1980 | United Kingdom | 53/553 |

*Primary Examiner*—John Sipos

*Attorney, Agent, or Firm*—Gipple & Hale

[57] ABSTRACT

A pass through apparatus and process for wrapping a web of stretched material around a conveyor transported load. The pass through apparatus has a film supply assembly on opposite sides of the load, each of the assemblies comprising a film dispenser and a powered roller mechanism which takes film from the film dispenser and pre-stretches it in the powered roller mechanism prior to the application of the film around the load. Once the load passes a sensing station, it is stopped and the clamping jaws draw the tensioned film around the load and clamp together short sections of film which have not been pre-stretched by the roller mechanisms. The film is then relaxed in the sealing area and is sealed in an untensioned un-pre-stretched state. The sealed webs are then severed allowing the wrapped load to be carried away by the conveyor with the film wrap slowly recovering its original configuration increasing the holding force of the wrap on the load.

22 Claims, 13 Drawing Figures

ROLLER STRETCH PASS THROUGH STRETCHING APPARATUS AND PROCESS

BACKGROUND OF THE INVENTION

The present invention generally relates to packaging and more particularly to an apparatus and method for making unitary packages which hold a plurality of components, each package containing a load wrapped in a web of stretched film.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking the sleeve to form a unitized package. The use of heat shrinkable film is described in U.S. Pat. Nos. 3,793,798; 3,626,645; 3,590,509 and 3,514,920. A discussion of this art is set forth in U.S. Pat. No. 3,867,806.

Another common method of wrapping loads is with rotary stretch wrapping machines. These rotary machines are commonly referred to as spiral or full-web machines, and can operate with the load rotating pulling stretched film web around it. Alternately, the load can be stationary and stretched film wrapped around the load with a rotating film dispenser.

The use of spiral wrapping machinery is well known in the art and such apparatus is typified by U.S. Pat. Nos. 3,003,297; 3,788,199; 3,863,425 and 4,136,501.

Additional references of interest which are pertinent to rotatable drives for wrapping packages are disclosed in U.S. Pat. Nos. 3,820,451; 3,331,312; 3,324,789; 3,309,839; 3,207,060; 2,743,562; 2,630,751; 2,330,629; 2,054,603 and 2,124,770.

A typical state-of-the-art full web apparatus is disclosed in U.S. Pat. No. 3,867,806. A similar full web apparatus using a tensioned cling film wrapped around a rotating load is shown in U.S. Pat. No. 3,986,611 while another apparatus using a tacky PVC film is disclosed in U.S. Pat. No. 3,795,086.

Stationary loads which are brought to a loading area and are wrapped by a rotating member which dispenses stretched film around a load are disclosed in U.S. Pat. Nos. 4,079,565 and 4,109,445. U.S. Pat. No. 4,079,565 discloses a full web vertical wrap of the load, while U.S. Pat. No. 4,109,445 discloses the horizontal spiral wrap of the load.

The elasticity of the stretched plastic film holds the products of the load under more tension than either the shrink wrap or kraft wrap, particularly with products which settle when packaged. The effectiveness of stretched plastic film in holding a load together is a function of the containment or stretch force being placed on the load and the ultimate strength of the total layered film wrap. These two functions are determined by the modulus or hardness of the film after stretch has occurred and the ultimate strength of the film after application. Containment force is currently achieved by maximizing elongation until just below a critical point where breaking of the film occurs. Virtually all stretch films on the market today including products of Mobil Chemical Company (Mobil-X, Mobil-C and Mobil-H), Borden Resinite Division PS-26, Consolidated Thermoplastics, Presto, PPD and others are consistently stretched less than thirty percent in applications because of irregularities in film braking systems.

The film stretching means on all currently marketed pallet stretch wrapping devices employ either direct or indirect friction to restrict the film as it is being wound onto the load during the wrapping process. The restriction is either applied to the roll of film itself (direct friction) or applied to the film after it is unwound from the film roll (indirect friction). The pallet and load serve as the winding mandrel providing all of the pulling force required to elongate the film.

The earliest type of stretch wrapper utilized a direct friction device in the form of a brake that is connected to the film roll through the core. The torque from the frictional brake device acts on the center of the film roll and as the roll changes diameter, the voltage to the brake is altered, either by the operator or automatically by a sensing device. A later film roll brake device illustrated by U.S. Pat. No. 4,077,179, utilizes a frictional brake attached to a shaft with a roller which is pressed against the freely mounted film roll. The film roll brake eliminates the need to change the brake force during the consumption of the film roll.

Various prior art indirect friction film stretching devices have been employed to restrict the film as it is wound onto the pallet during the wrapping process. One of these devices, commonly referred to as an "S" type roller device, utilizes an idle roller followed by a braked roller over which the film is threaded prior to wrapping the load. The function of the two rollers is to align the film for maximum contact with the braked roller. Another indirect friction device having fixed bars was marketed by Radient Engineering Corporation under the trade name POS-A-TENSIONER and has been subsequently marketed by the Kaufman Company under the trade name TNT. This device has a series of fixed non-rotating bars positioned adjacent to the film roll. The film web is threaded around the bars whose relative angles can be changes for ultimate tensioning. As the film web is attached to the pallet it is drawn across the bars and the friction between the film and the smooth surface of the bars provides a restriction causing the film to stretch. This device uses multiple bars with the film web stretching incrementally between each bar. Neck down of the film web increases between each bar and the load bears the force. As the load rotates, the wrap angle changes from the last bar so that the wrapping force greatly varies depending on the relative angles. The frictional restraint is determined by the vector of the film web on each bar. Thus, the device is very sensitive to the force placed on the unwind roll and the force increases as the roll size decreases adding additional force on the system. Furthermore, there must be some friction placed on the supply roll to prevent backlash. While this device solves to some degree the irregularities of the brake and the hostility of the film roll, it can only apply limited stretch to the load and does not handle different film compositions with any degree of standardization.

Another stretch wrapper device was introduced by the Anderson Company at the PMMI Show in Chicago in 1978. This device interconnected the turntable drive motor with a pair of nip rollers immediately downstream from the film unwind roll. The nip rollers were synchronously driven with the turntable rotation through a variable transmission which could be increased or decreased in speed relative to the turntable rotation speed. Thus the stretch on the film was affected between the constant-speed nip rollers and the pallet turning. It is not known if this machine was ever commercialized, principally because of its inability to achieve satisfactory stretch over the load corners due to its failure to respond to the speed change that these corners represented. The pallet, as the film accumulating mandrel, provided the total force that was required to stretch the film from the driven nip rollers with all of the stretch occuring after the passage of the single pair of nip rollers to the pallet.

In addition to the previously noted prior art, direct friction pallet stretch wrapping machines of the pass through type have been manufactured by Weldotron and Arenco (Model No. MIPAC). These machines have a significant problem in stretching the film and normally stretch film around the load in the range of about five to ten percent by driving the pallet and associated load through a stretched curtain of film to place the stretching force on the front or sides of the load.

A typical pass through system is disclosed in U.S. Pat. No. 3,596,434. In this reference, a pallet load is transported along a conveyor and the leading face of the pallet load contacts a vertical curtain of film web formed by heat sealing leading ends of film webs dispensed by two rolls of film on opposite sides of the path of the pallet load. The pallet load continues to move along the conveyor, carrying with it the sealed film curtain until the two sides faces of the pallet load as well as the front face are covered by film web. A pair of clamping jaws then close behind the pallet load, bringing the two film web portions trailing from the side faces of the pallet load into contact with one another behind the pallet. The jaws then seal the film web portions together along two vertical lines, and cut the film web portions between those two seals. Thus, the film web portions are connected to cover the trailing face of the pallet load, and the curtain across the conveyor is re-established to receive the next pallet load. The pallet load may subsequently be exposed to heat in order to shrink the film web and apply unitizing tension to the load, as is disclosed in U.S. Pat. No. 3,662,512. Another disclosure of relevance to pass through wrapping is U.S. Pat. No. 3,640,048 which shows that film may be applied to the top and bottom of the pallet load prior to the wrapping cycle when it is desired to cover all six surfaces of the pallet load with film.

Since most pallet loads will not hold together while being subjected to these unequal forces, the film web is normally tensioned after the film jaws begin their inward travel over the end of the pallet load. This form of tensioning severely limits the degree of elongation of film which is able to be achieved, and pulls excess film around the two rear corners of the load while the jaws are closing. This frequently causes film tears when the film is stretched more than ten percent.

An inherent problem with pass through packaging is that the primary strength and reliability of the package is determined by the consistent quality of the seal. These seals depend on a careful maintenance of the sealing jaw and are never as strong as the film itself. As previously mentioned, stretched film webs are difficult to seal because the stretched film is oriented and the seals can be torn by the stretch forces on the film or load shifting within the package wrap. In the prior art pass through machines, the stretch on the wrap which may be as much as ten percent, takes place at the seal with very little stretch being imparted around the load. In the present invention, there may be one hundred percent elongation around the load and zero percent elongation at the seal, resulting in unoriented film which will seal easier.

When low stretch rates of one to ten percent are produced, several packaging problems occur. The unitizing containment forces on the load are less than the optimum force which can be obtained. This minimizing of containment forces can result in a potential loosening of the film wrap during shipment where the load settles and moves together thereby reducing the girth.

Another problem is that non-vertical sides and corners on an irregular load places extreme force on a small area of film during stretching, thereby causing a partial rupture at a point well below the force achieveable on a flat side. This partial rupture causes a transfer of force to the remaining portion of the web which is frequently sufficient to produce a "zippering" of the entire film web.

One attempt to overcome these problems is seen in French Pat. No. 2,281,275 assigned to SAT. The '275 reference discloses the prestretching of plastic film by taking the film web from the film roll through a powered roller system having a speed differential of $V_2-V_1$ which stretches the film. The film leaving the second set of rollers is drawn off at a speed which is equal to or less than $V_2$ as it is wrapped around the load. V, which is the speed of rotation of the pallet load, is less than or equal to $V_2$, the speed of the stretched film coming off of the second roller assembly.

Although the French reference appears to achieve film web stretch in excess of the one to ten percent range obtained in the aforementioned pass through stretch wrapping machines, other problems remain. The system requires manual operation or complex automatic feedback to accomodate the change in film take-up speed as the pallet load surfaces pass by the downstream rollers. This reference does not teach the benefit of stretching the film above the yield point with increased strength per cross-sectional area and increase in modulus. There is furthermore no teaching of reducing the force on the portion of the film web between the downstream powered rollers and the load with inelastic strain recovery as a technique for reducing wrapping force while holding high levels of elongation.

A commercial model based on FIG. 8 of the '275 reference is currently being marketed by SAT. In this embodiment the film web is pre-stretched by extending a pair of rollers forward while braking the film rolls. The load is carried into the pre-stretched "U" shaped sleeve and the rollers are transported back of the load allowing the sleeve to engage the load. Sealer bars are then projected inward to seal the web ends together.

The present invention is constructed to overcome these difficulties which are present in the prior art devices.

SUMMARY OF THE INVENTION

The present invention relates to a process and apparatus for applying stretched plastic film to pallet loads for containment of the loads using a pass through apparatus having opposing film stretching assemblies. Each assembly is formed with two connected sets of powered rollers driven at different speeds to elongate the plastic film between the connected rollers so that the film is pre-stretched before it leaves the rollers allowing the stretched film to be carried by the load transported through the pass through apparatus.

The film stretching assemblies pre-stretch the film dispensed from supply rollers so that the film is substantially stretched or elongated beyond its yield point before it is wrapped around the load holding the load under compressive forces.

Most plastic films when stretched above their yield point gain significantly in modulus and cross-sectional strength. The typical polyethylene film will multiply three times in strength in pounds per square inch (psi) of cross sectional area after being elongated three hundred percent. This significant increase in strength begins approximately when the yield point of the film is exceeded in the elongation phase. The yield point is achieved between fifteen and forty percent stretch for virtually all stretch films being used today. Limitations of friction-based constant force devices prevent current stretch wrap applications from achieving the higher levels of containment force and ultimate strength available in the foremost plastic films.

Thus, the present invention allows more than double the practical level of elongation currently experienced with prior art "brake" systems used in current pass through apparatus in that the invention has the capability to wrap highly elongated film with minimal wrapping forces. The wrap gives higher containment forces on the load and/or lower film costs. The holding or containment force on the load increases after the wrap is complete as the prestretched film slowly tries to recover its original dimensions. The film, in effect, shrinks around the load as it leaves the wrapping station much the same as it would going through a shrink tunnel.

The invention also allows for more precise control of elongation allowing the user to get maximum cost efficiency from the new yield films, along with higher film strength or modulus achieved at high levels of elongation.

The higher levels of elongation which are achieved on the film can be achieved without disruptive forces on the load because the film is being stretched between the stretching rollers rather than being stretched by the clamping jaws and/or the load as it carries the film web against a braked set of rollers.

The novel construction of the invention provides for isolation of the film rolls from the stretch forces greatly reducing film failure from roll end damage or rolldown of the film under force. When film is braked from the surface, the film will elongate against the place where the film is damaged (a nick or wrinkle in the roll of film) causing a tear. Where there is film edge roll (a common situation where the film layers roll under each other), a tear will occur as the film is pulled out under tension. Roller stretching the film web lifts the film off of the roll without tension and with no tension against the roll. The use of this simplified construction thus eliminates the need for currently used friction brakes and the problems of those brakes such as speed variation, breakaway from stop position, temperature variation, wear and operator control meddling.

It can thus be seen that the present invention provides a unique apparatus and process using interconnected driven rollers having a speed differential which provides a pulling action on the film causing it to be pre-stretched before it is subjected to the force caused by the moving load. The pulling action is effected when the film is stretched above the yield point between the rollers and only minimal force is placed on the film after it leaves the rollers as determined by the spring tension of the apparatus. The present invention essentially reduces the neck-down of the film web normally experienced at high elongation rates by limiting the stretching action to a minimum distance between the rollers and does not need to stretch the film between the driven rollers and the load. The driving force is obtained by placing the high speed and the low speed rollers closely together and rotating the driven rollers in opposite directions. Thus the film is pre-stretched except where the film seal is made. When the film area that will receive the seal passes through the stretching rollers, the elongation mechanism is disengaged so that this area remains un-pre-stretched. After the web is clamped around the load, a pair of slacking rollers relax the tension of the film in the seal area, thus resulting in the seal being made on both untensioned and un-pre-stretched film. The invention pre-stretched selectively and relaxes the film web at the time of sealing making it easier to seal the film webs together since they are not under tension.

Thus, the seal of the wrap is more consistent and stronger than the seal of the prior art devices as the film web is relaxed at the point of sealing to make a seal on relaxed film.

These and other objects and advantages of the present invention will be more readily apparent in the following discussion when read in conjunction with the accompanying drawings, in which:

DETAILED DESCRIPTION OF THE DRAWINGS

Figure 1:
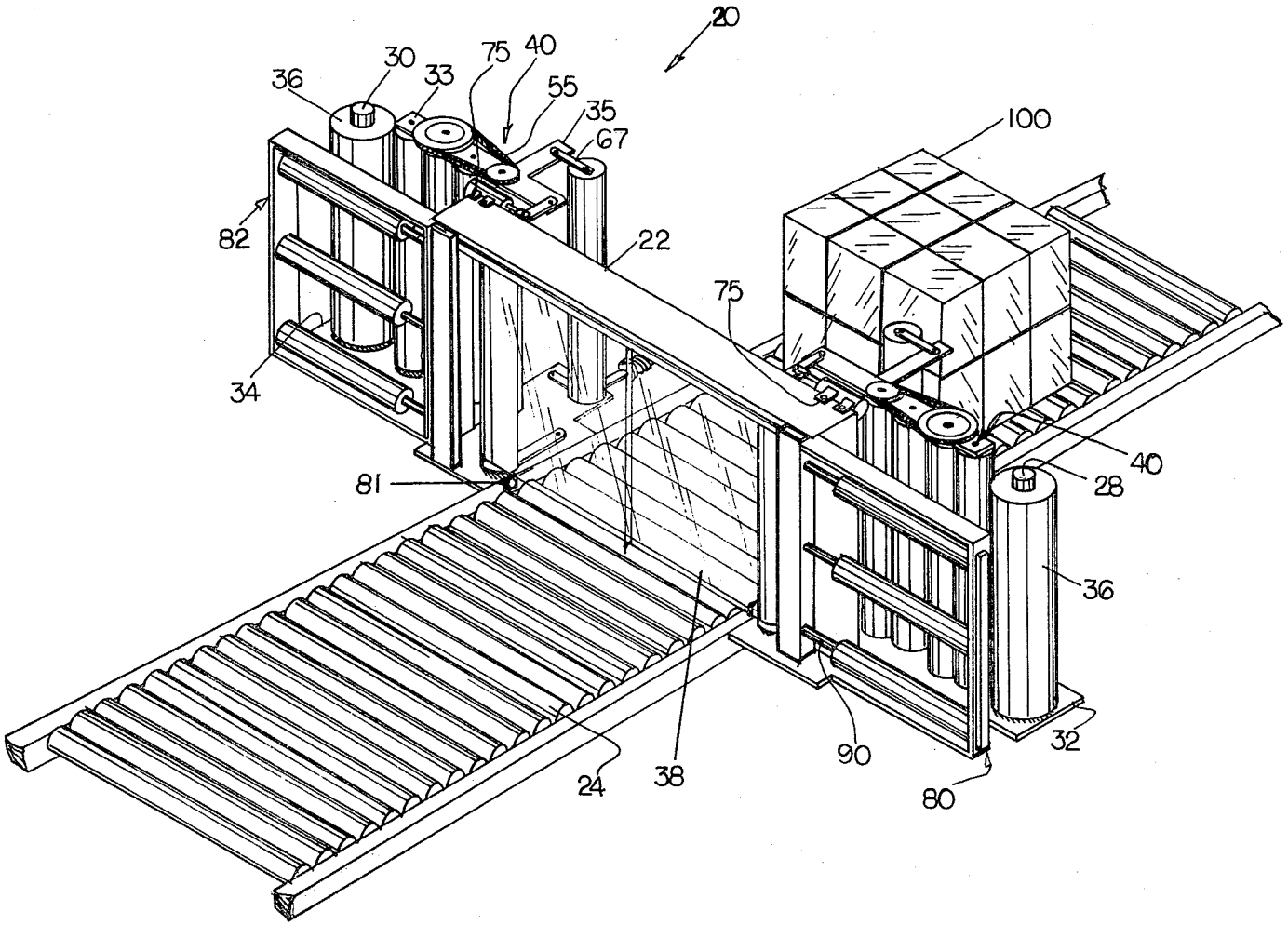
FIG. 1 is a perspective view of the inventive pass through stretch wrapper apparatus.

The improved pass through wrapping apparatus 20 is shown by FIGS. 1 through 13. The operation and description of the apparatus and its respective component parts are discussed in the following description.

The inventive pass through powered stretch wrapping apparatus 20 comprises a frame 22 through which a powered conveyor assembly 24 is positioned. A typical state-of-the-art pass through machine is disclosed in U.S. Pat. No. 3,596,434. In the invention, rotatable film supply shafts 28 and 30 are respectively mounted on base plates or members 32 and 34 which form part of the frame 22. Each of the rotatable shafts are adapted to receive and hold a film supply roll 36. The film supply roll comprises a rolled film web 38 of a stretchable material composition.

The invention is designed to function with stretchable film webs such polybutylene, polyethylene, or a copolymer, or blends thereof. Typical films which can be used in the inventive apparatus are EVA copolymer films with a high EVA content such as the film maufactured by Consolidated Thermoplastics "RS-50", Bemis "Super-Tough" and PPD "Stay-Tight" films. Other films which can be used, commonly called "premium films", such as Mobil-X, Presto Premium and St. Regis, utilize a new low pressure polymerization process resin manufactured by Union Carbide and Dow Chemical Company. This resin, called linear low density polyethylene, has significantly different stretch characteristics than previous stretch films. These characteristics allow the film to withstand the high stress of extreme elongation without tearing during wrapping of the pallet.

It should be noted that film, film material and film web are used interchangeably throughout the present specification.

Figure 4:
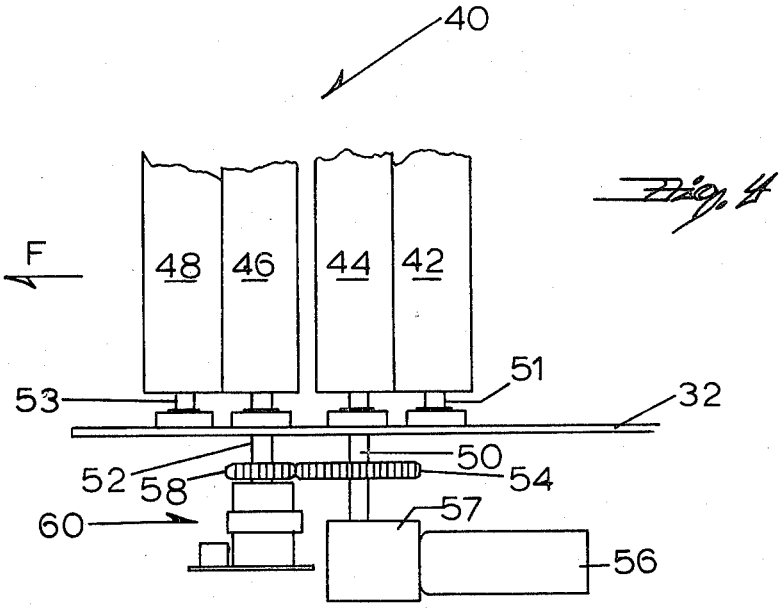
FIG. 4 is a reduced front elevational view of the film stretching assembly shown in FIG. 3.
Figure 3:
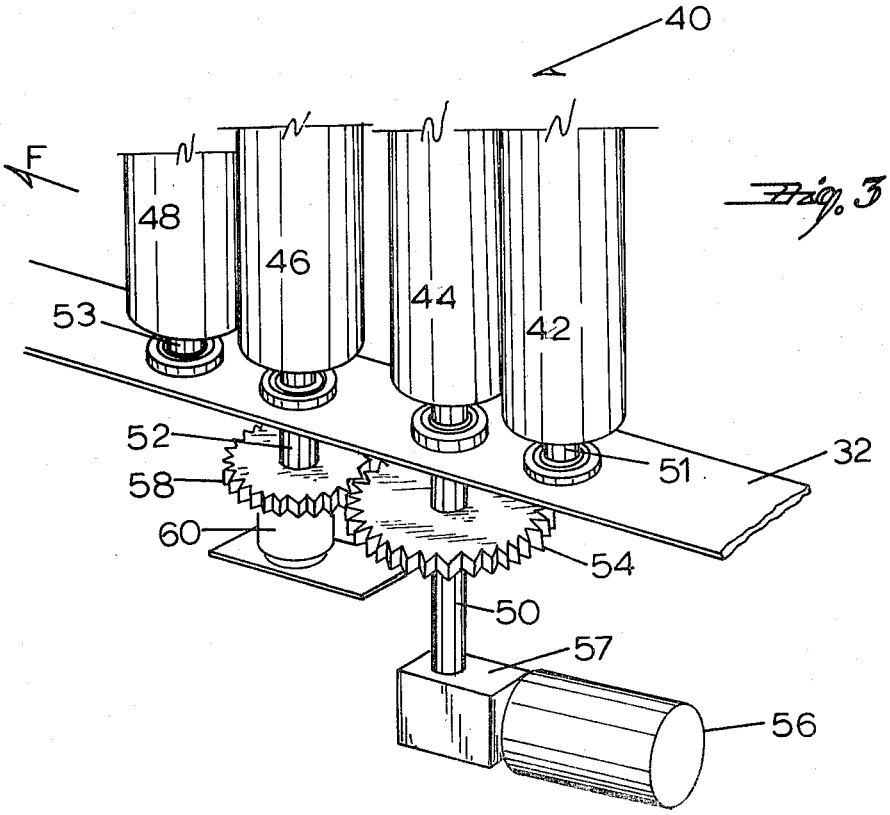
FIG. 3 is an enlarged partial perspective view of one of the film stretching assemblies used in the invention.
Figure 6:
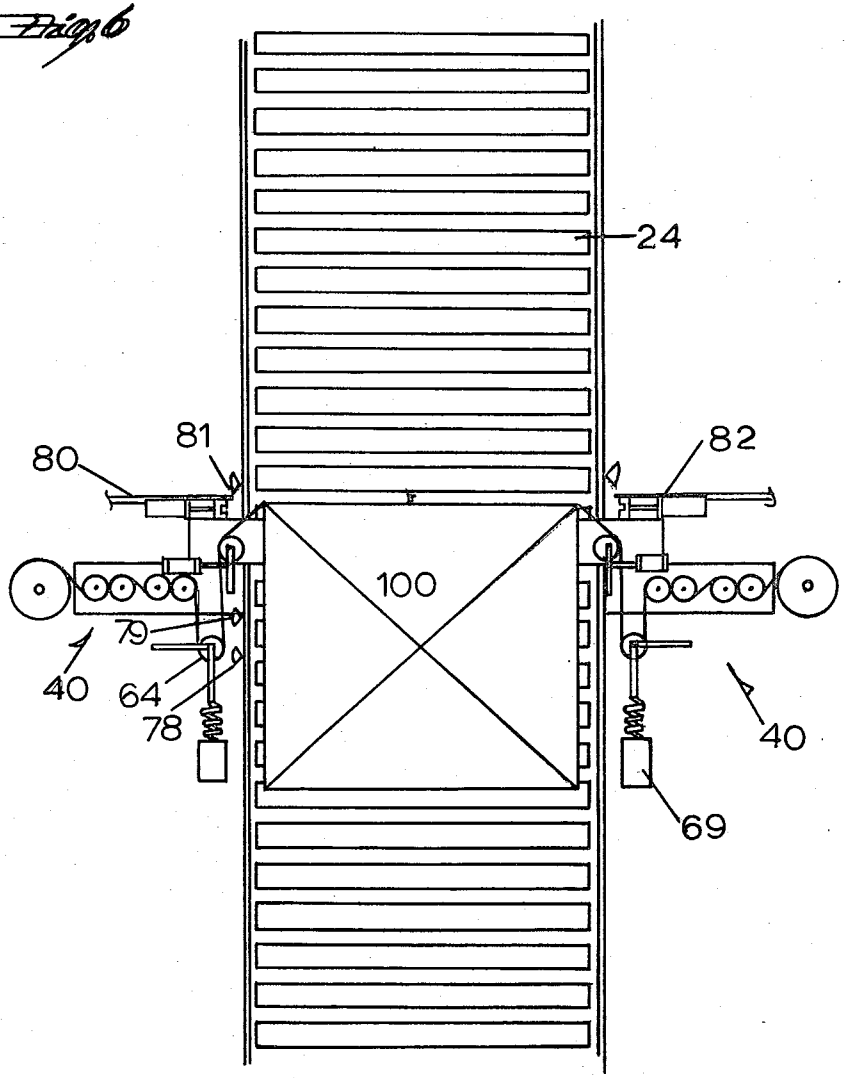
FIG. 6 is a sequential top plan view of the apparatus shown in FIG. 5 showing the load engaging and carrying the film web.
Figure 5:
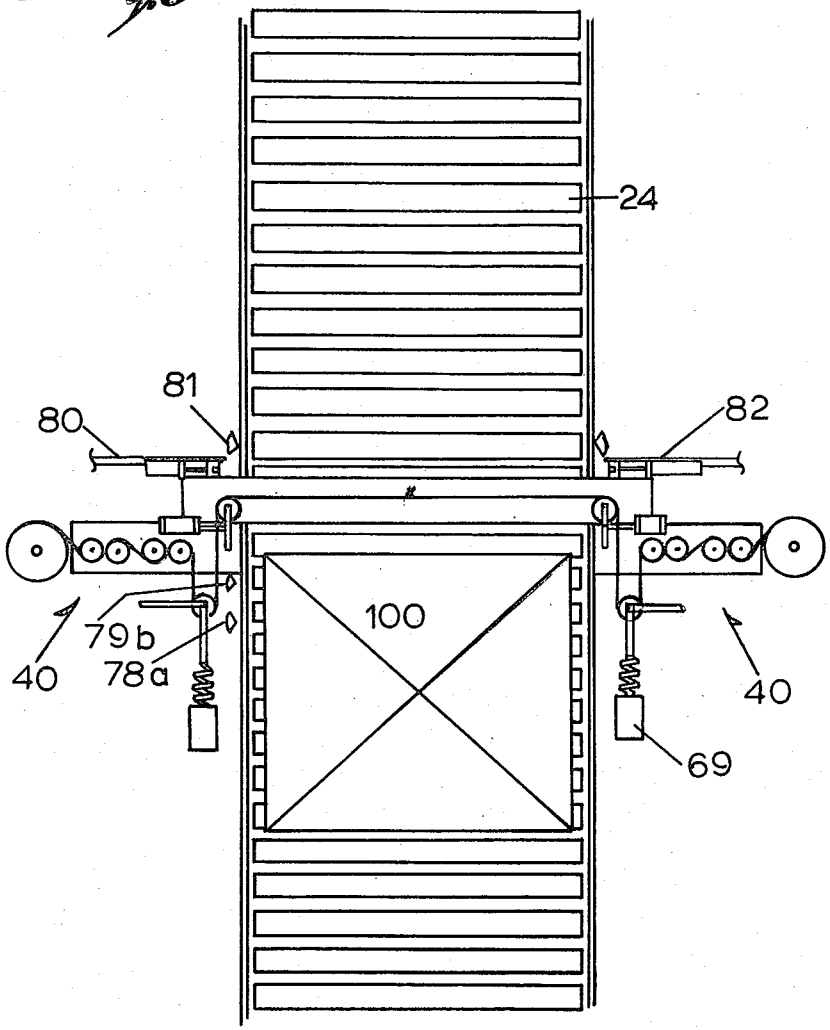
FIG. 5 is a top plan view of the inventive apparatus with a load being transported toward the film web.
Figure 8:
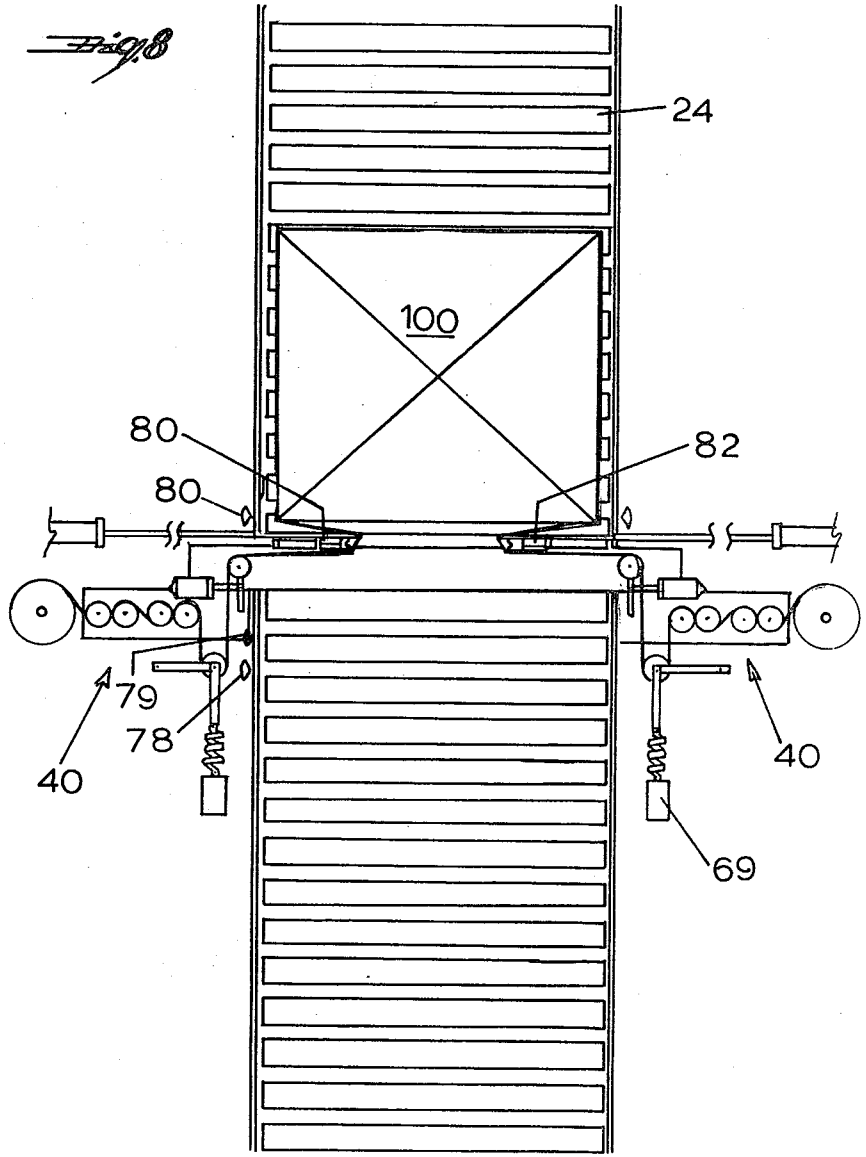
FIG. 8 is a sequential top plan view of the apparatus of FIG. 7 showing the load having passed through the apparatus with the sealer bars moving inward.
Figure 7:
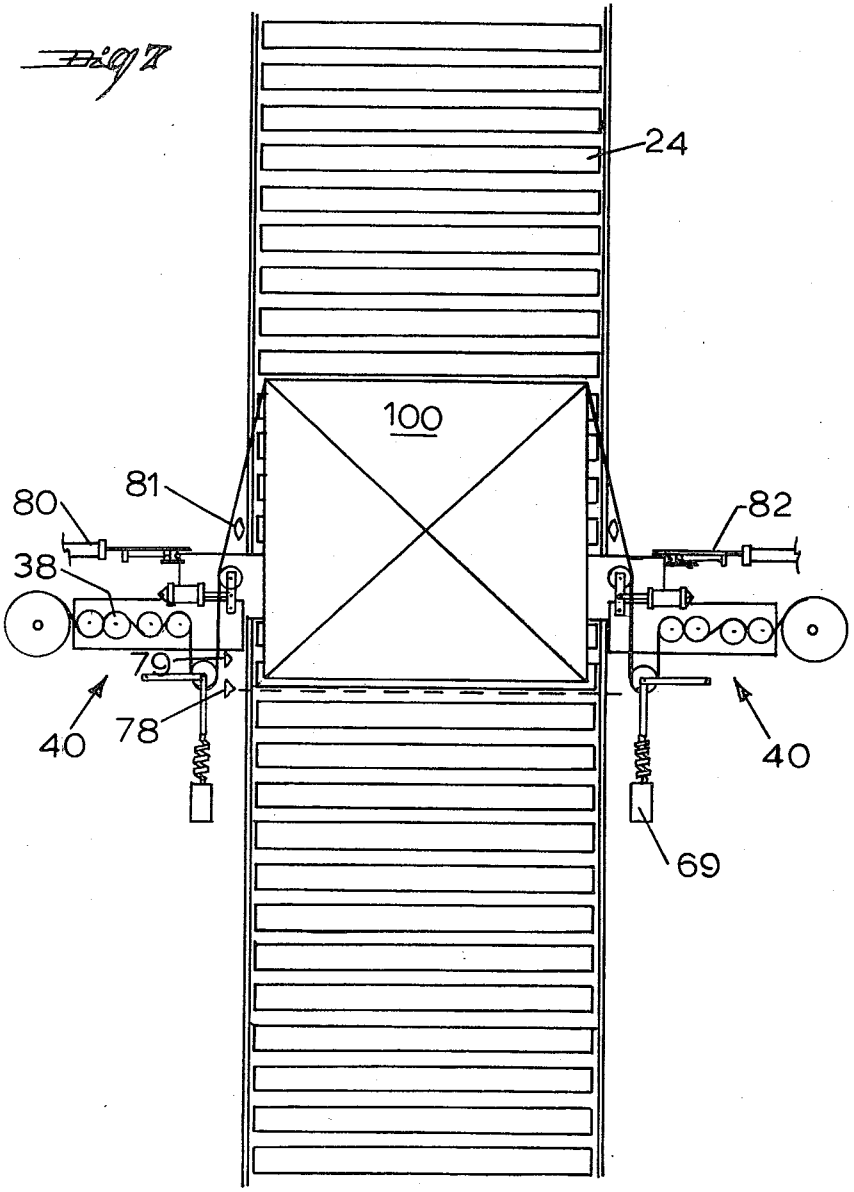
FIG. 7 is a sequential top plan view of the apparatus shown in FIG. 6 showing the end of the load entering the sensing station.
Figure 11:
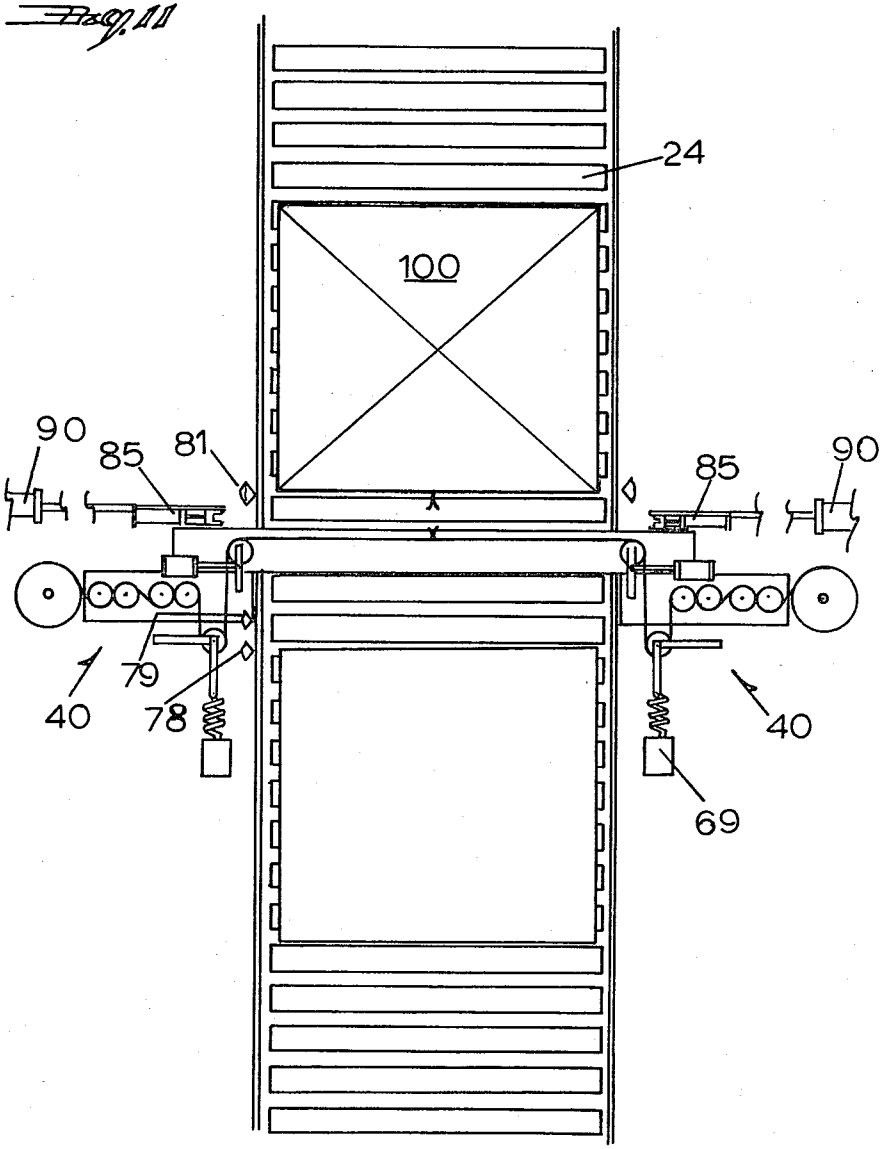
FIG. 11 is a sequential top plan view of the apparatus shown in FIG. 9 with the load having been wrapped and severed from the film web, and a new load approaching the apparatus.
Figure 9:
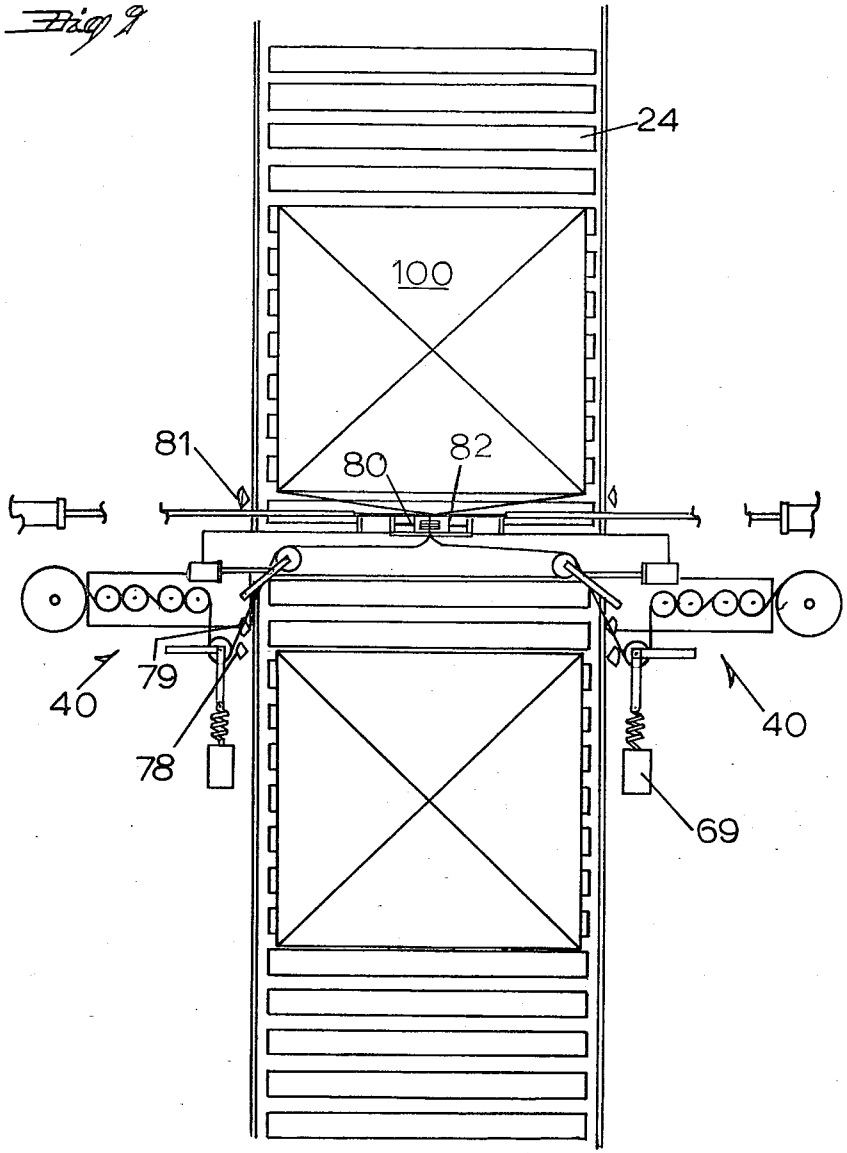
FIG. 9 is a sequential top plan view of the apparatus of FIG. 8 with the sealer bars fully extended to seal the film webs together.
Figure 12:
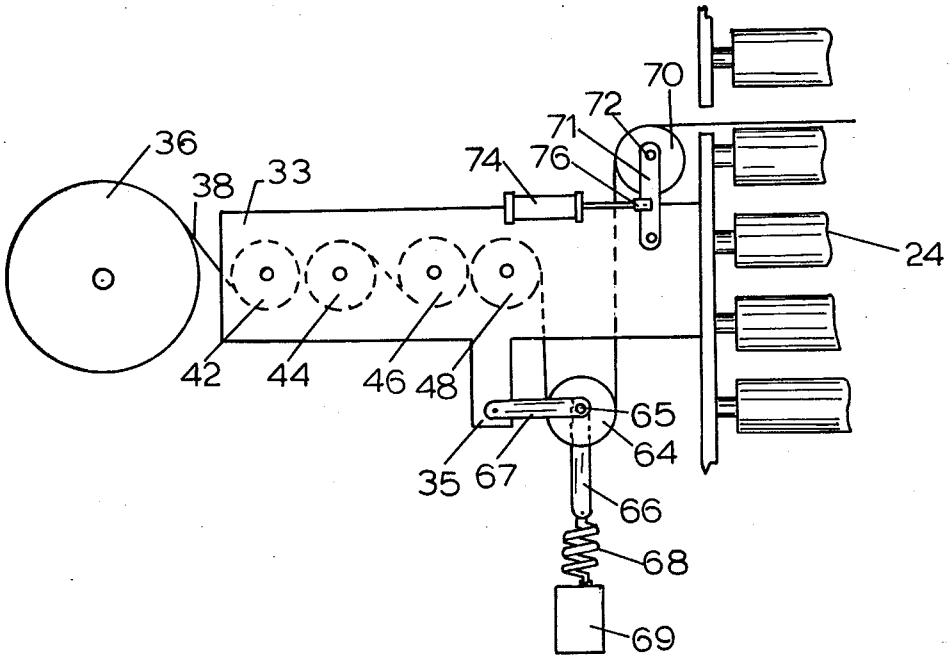
FIG. 12 is an enlarged top plan view partially in phantom of the left-hand side film stretching assembly of the stretch wrapper apparatus.
Figure 13:
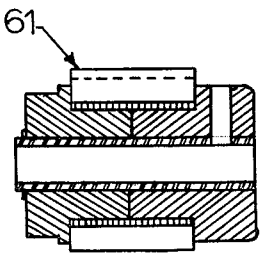
FIG. 13 is a cross-sectional view of a prior art clutch used with the invention.

A film elongation assembly 40 is mounted on each of the base plates adjacent to the respective film supply rolls. The film elongation assembly 40 is best shown in FIGS. 3, 4 and 12. In the preferred and best mode of the invention, each of the film elongation assemblies 40 is provided with a first pair of low speed rollers 42 and 44 and a second pair of high speed rollers 46 and 48. The rollers are preferably constructed of a resilient rubber-type material such as polyurethane, preferably having a durometer of between 42 and 52. Rollers 44 and 46 are respectively mounted on rotatable shafts 50 and 52 which extend through the opposing base plates 32 and 34. Rollers 42 and 48 are mounted on rotatable shafts 51 and 53 respectively which are journalled in each base plate. The upper ends of shafts 50 through 53 are journalled in a planar top plate 33 having a rearwardly projecting leg 35. A drive gear 54 is mounted on shaft 50 and rotates as the shaft is driven by a motor 56 and reducer mechanism 57. Drive gear 54 engages a driven gear 58 which is connected to a clutch assembly 60 so that when the clutch assembly 60 is activated, gear 58 is released from engagement with shaft 52, thus allowing roller 46 to free-wheel. Alternatively, the rollers can be driven by chain and sprocket drive 55 such as that shown in FIG. 1.

The clutch assembly 60 used is a standard ON/OFF clutch of the type well known and disclosed in the art by U.S. Pat. Nos. 3,373,851 and 3,521,730, and incorporated herein by reference. The preferred clutch is an over-the-counter purchased item identified by the Warner Electric Brake and Clutch Company as SP-6-SS-CCW-SI-115-CAV 1 inch bore-4 stop model no. 7 which is activated by external blocking or releasing of its surrounding stop collar 61. This prior art clutch is further shown in FIG. 13. By disengaging this clutch for the period of time that the back of the load goes from A to B, (the distance between the infra-red photocells 78 and 79), the film will be in an unstretched condition in the sealing area at the end of the wrap. Thus, the purpose of the clutch is to disengage the roller stretch mechanism for a brief period of time so that the seals are formed on un-pre-stretched film web. The slacking rollers relax the same portion of un-pre-stretched film before the seal is made so that the film web is untensioned.

The gears 54 and 58 are sized depending upon the amount of film elongation required, thus the surface movement of rollers 46 and 48 can be about forty percent, seventy five percent, two hundred percent or three hundred percent faster than the surface movement of roller 44 and its' equivalent paired roller 42. While stretching normally ranges from forty percent to three hundred percent, excellent results have been obtained when narrow ranges of pre-stretching are required such as stretching material forty to seventy five percent, seventy five percent to two hundred percent, and in some instances over three hundred percent. While the film elongation has been noted in general terms of percent of stretch, optimum results are achieved when the plastic film material is elongated substantially past its yield point to obtain the benefits of increased film strength and modulus per cross-sectional area. However, the invention can also be used on film which is not stretched past its yield point. Thus, it can be seen that both sets of rollers are driven by the variable speed DC motor 56 through a reducer 57 connected to shaft 50 of roller 44. It is also apparent that the reducer 57 could be connected to either roller shafts 50 or 52 with the clutch mounted to the other shaft. After the film web 38 has been pre-stretched to the desired elongation, it is passed around a pivot roller 64 mounted on shaft 65 as is best shown in FIG. 12. The shaft 65 is pivotally connected to leg 35 and either base plate 32 or 34 by pivot arms 67. A sensor arm 66 is mounted to the bottom end of shaft 65 and is connected by a spring 68 to sensor 69. The sensor 69 can be in the form of a strain gauge. The sensor 69 determines the force of the film web being carried by the load 100 and is connected by suitable circuitry well known in the art to vary the speed of motor 56 so that the film webs being pulled off of the film rolls 36 by drive rollers 42 and 44 is controlled by the speed of the film web being carried down the conveyor assembly path by the load 100. A slacking roller 70 is pivotally mounted to each respective base plate 32 or 34 and top plate 33 by means of pivot arms 71 which have one end pivotally mounted to the slacking roller shaft 72 and the other end to the top plate and the base plate. The slacking roller 70 is transported by a pneumatic cylinder assembly 74 which is mounted to the frame 22 by brackets 75. The piston rod of the cylinder is provided with a yoke 76 which is secured to the upper pivot arm.

Infra-red photocells 78 and 79 are placed at one edge of the conveyor 24. Alternatively, the photocells may be illuminated by a light source placed at the edge of the conveyor 24 opposite the photocells. Photocell 78 produces a first signal after the rear of load 100 passes it causing the clutch 60 to disengage allowing a section of unstretched film to pass through the pre-stretching assembly 40, and photocell 79 produces a second signal when the rear of load 100 passes it, which re-engages the clutch and resumes the pre-stretching of the film web.

When the rear of the load clears the sealing jaw assemblies 80 and 82, a signal is received from infra-red photocell 81 activating cylinder banks on each side of the conveyor. Sealer and cutter heads 84 and 86 are respectively mounted to cylinders 85 and 85', which are in turn laterally transported by the fluid cylinders 90 of each cylinder bank. Each jaw assembly has a clamp jaw 88 which is transported by clinders 90 to engage and carry the film web from each of the rolls and clamp them together behind the load. At this point, the slacking rolls 70 are extended to slacken the film. It is well known in the art to use sensors and photocells to activate fluid cylinders and such operation need not be discussed in this description of the invention.

Figure 10:
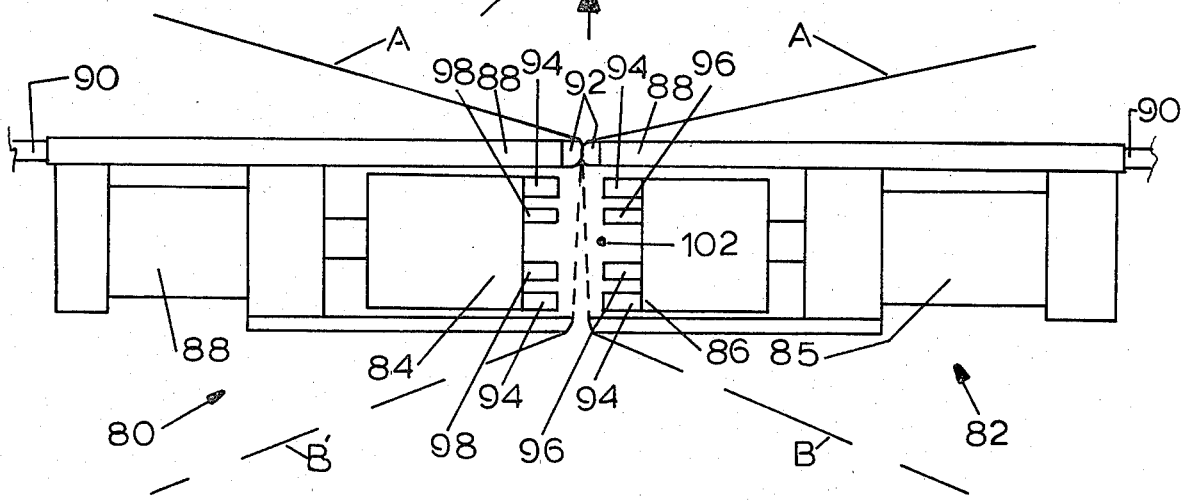
FIG. 10 is an enlarged cross-sectional view of the sealer bars shown in FIGS. 8 and 9.
Figure 2:
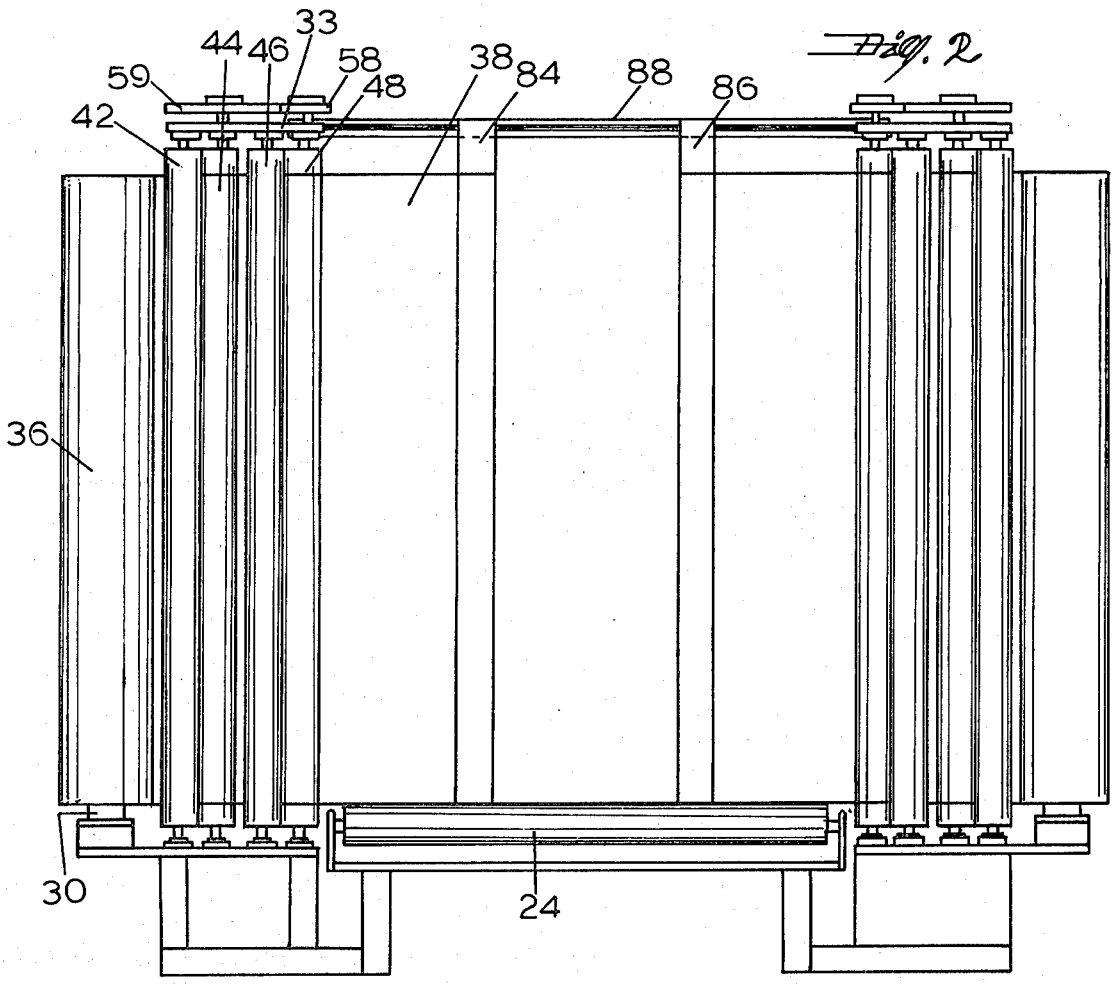
FIG. 2 is an enlarged front elevational view of the apparatus shown in FIG. 1.

The sealing and cutting heads 84 and 86 and the clamp jaws 88 are most clearly illustrated in FIG. 10. As will be discussed in more detail, in the operation of the apparatus, the heads 84 and 86 and outer clamp jaws 88 are transported inward by pneumatic cylinders 90 with the jaws 88 carrying un-pre-stretched segments of film web represented by lines AB, A'B' together so that the rigid outer clamp jaws 88 hold the segment AB of film web against segment A'B' of the other film web by means of clamping pads 92. After the rigid clamp jaws 88 are clamped together, the slacking rollers 70 are extended, untensioning the film, and cylinders 85,85' are activated to carry heads 84 and 86 toward each other to initiate the clamping, sealing and cutting modes. Secondary clamping pads 94 are mounted in the respective heads 84 and 86 and head 86 is provided with two nichrome sealing bands 96 which seal the film web segments A'B',AB together as they butt against sealing pads 98. A heated nichrome wire 102 is mounted in head 86 between the sealing bands 96 so that the film webs are severed to form a sealed trailing edge on the wrapped load and a sealed leading edge for an incoming load to be wrapped.

While the apparatus is shown on opposite sides of the conveyor, it is also envisioned that it could be rotated 90° so that it would be positioned above and below the conveyor with the web of film extending through the conveyor and perpendicular thereto.

In operation of the apparatus, connected webs of film 38 are pre-stretched between two opposing roller assemblies. The webs had previously been connected by the sealer heads at the end of the previous load or by hand in the case of the initial load. If there was a prior load taken off by powered conveyor 24, the rollers in the roller elongation assemblies, both high speed and low speed, are rested or do not engage at this time, while the slacking rollers 70 are retracted to hold the film tight.

When load 100 engages the connected film webs 38 it increases the force on sensor 69 which starts the roller stretch assemblies 40 and controls the speed of the motors 56 so that they rotate the rollers to pay out film at a rate to hold a predetermined tension in spring 68 and thus a tension in the film web around the load. The high speed rollers 46 and 48 feed the film to the load while the low speed rollers 42 and 44 turn at a given preselected ratio to the high speed rollers providing the force to pre-stretch the film between the high speed and low speed rollers. The force from roller stretch assemblies 40 to the load is maintained below the force within the roller stretch assemblies to allow inelastic strain recovery of the film web to the load. Continuous checking and equalization of the speeds of the load and film feed-out is maintained by sensor mechanism 69 which signals and controls the speed of motor 56 by circuit means well known in the art. By varying the roller surface speed ratio or circumference, film elongation can be positively controlled to the degree desired. As a load 100 progresses through the frame mast, the film web 38 is fed out of respective film rolls at a variable speed and accumulates around the load 100 in a pre-stretched condition of fifty percent, one hundred percent or two hundred percent stretch depending upon the gear ratio.

When the rear of the load passes photocell 78 (film point A) the clutch 60 is released until the rear of the load passes photocell 79 (film point B) at which point the clutch is re-engaged. This will produce a section of film AB(A'B') that is under tension determined by sensor 69 but not pre-stretched. By properly positioning photocells at points A and B, and because the slacking roller 70 will have released the tension imposed by spring 68 (see FIG. 9), the seal will be made on untensioned and un-pre-stretched film. This significantly improves the quality and reliability of the film seals.

Once the load has passed through frame 22 clearing the sealer and cutter heads and carrying the pre-stretched film web wrapped around it, the end of the load is sensed by a photocell 81. The photocell activates a relay circuit to halt the conveyor and to start the clamping cylinders 90. The heads 84 and 86 are transported by their respective cylinders 90 toward the center of the apparatus and toward each other until the clamp jaws 88 close behind the load 100 and superimpose the two webs of film. The high speed rollers 46 and 48 feed out film at a rate sufficient to maintain the same force on sensor 69 thus providing equal tension around the entire load. When the clamping pads 92 of clamp jaws 88 have been fully clamped, the slacking rollers 70 are activated by state-of-the-art circuitry to slacken the film leading to the sealing jaws 88. The sealing heads 84 and 86 are then driven together by cylinders 85 and the film is sealed in the section AB,A'B' that was not pre-stretched and is now without tension. The film is double sealed by nichrome sealer bars 96 and cut between the double seals by cut-off wire 102 to seal the package around the load and form a sealed connected film web for the subsequent load. Since the following load is staged on the in-feed portion of conveyor 24, this allows for virtually constant product flow. After sealing and cutting cylinders 85,85' return the heads 84 and 86 to a retracted position, and the jaw assemblies are retracted by cylinders 90 to a START position, the slacking rollers 70 are returned to their tensioned position.

The wrapped load proceeds down the exit portion of the conveyor as the following load proceeds into the system to be wrapped. As a completely wrapped load is carried away, the film memory tightens the film web around the load holding the load under containment. The pre-stretched web of film is positioned between the high speed rollers and the cycle begins for the wrapping of the next load.

It should be noted that some steps of the wrapping process could be interchanged without departing from the scope of the invention. Furthermore, these steps can be interchanged and are equivalent.

In the foregoing description, the invention has been described with reference to a particular preferred embodiment although it is to be understood that the specific details are merely illustrative and that the invention may be carried out in other ways without departing from the true spirit and scope of the appended claims.

What is claimed is:

1. Apparatus for wrapping a web of stretched plastic film around a load comprising conveyor means for transporting a load, said conveyor means providing a horizontal load path for the load; film supply means for supplying a web of plastic film across the load path, said conveyor means being adapted to transport said load against the web of film positioned across said load path and carry the web of film along said path, said film supply means comprising at least two film stretching assemblies, each of said assemblies being positioned on opposite sides of said load path, each of said film stretching assemblies comprising a film supply roll, speed connected upstream and downstream roller means to pre-stretch film dispensed from said film supply roll above the yield point of the film prior to application of the film around said load, means to drive said connected upstream and downstream roller means at different relatively constant speeds to exert a force on the film so that the upstream roller acts to retard the film with respect to the downstream roller stretching the film between said roller means and to reduce the force between said load and said assemblies, a pair of moveable clamping sealing jaw assemblies positioned on opposite sides of said load path, transport means to transport said jaw assemblies connected to said jaw assemblies, said transport means adapted to transport each of said jaw assemblies toward each other to engage sections of film from each said film supply means, said jaw assemblies carrying said sections behind the load and clamping the sections together; said jaw assemblies including sealing means for sealing said sections together in at least two spaced apart seals and severing means to sever said sections between said at least two spaced apart seals to complete the wrap of the load.

2. Apparatus as claimed in claim 1 wherein said severing means comprises a heated cut-off wire mounted in one of said jaw assemblies.

3. Apparatus as claimed in claim 1 wherein each of said film stretching assemblies comprise a base member, motor means, a rotatable film roll mounted to said base member, a low speed roller mounted to said base member positioned adjacent said film roll and a high speed roller mounted to said base member and connected to and driven by said motor means connected at least to one of said rollers, said film web being withdrawn from said film supply roll and passing through said rollers so that stretching of the film web takes place between the low speed roller and the high speed roller.

4. Apparatus as claimed in claim 3 including sensor means positioned downstream of said high speed roller, said sensor means engaging the film after the film web has passed through the high speed roller and sensing the force that the film is being pulled by the load, said sensor means being electrically connected to said motor means, and controlling the speed of the motor means so that the tension in the film being discharged from the high speed roller remains relatively constant during the wrapping of the load.

5. Apparatus as claimed in claim 4 wherein said sensor means comprises a pivotal roller assembly, said roller assembly being provided with at least one arm thereto which is connected to spring means, said spring means being connected to a sensor mechanism.

6. Apparatus as claimed in claim 5 wherein said sensor mechanism is a strain gauge.

7. Apparatus as claimed in claim 5 wherein said spring means is a pneumatic cylinder.

8. Apparatus as claimed in claim 3 including slacker means mounted to said base member, said slacker means engaging said film and being adapted to provide predetermined slack in the film travelling to said load at a predetermined time.

9. Apparatus as claimed in claim 8 wherein said slacker means comprises at least one arm mounted to said base member a roller rotatably mounted to said at least one arm and means connected to said arm to rotate said roller around a pivot point in response to a signal.

10. Apparatus as claimed in claim 3 including a clutch means mounted to a shaft of one of said rollers, said clutch means being adapted to selectively allow said rollers to be driven or to free-wheel.

11. Apparatus for wrapping a web of prestretched plastic film one time around a load comprising conveyor means for carrying a load, said conveyor means providing a horizontal path for said load, a frame mounted adjacent said conveyor means, film supply means mounted on said frame on opposite sides of said conveyor means, said film supply means being adapted to supply a web of plastic film in a vertical position across said load path, said film supply means comprising a plurality of film assemblies, each of said assemblies comprising a base member, a rotatable film roll mounted to said base member, low speed roller means mounted downstream from said rotatable film roll, high speed roller means mounted to said base member and interconnected to said low speed roller means, motor means connected to one of said roller means to drive both said roller means to exert a force on said film so that film from said rotatable film roll when passed partially around the surfaces of said low speed and high speed roller means is stretched between said low speed and high speed roller means substantially above the film's yield point thereby changing the film's strength characteristics per cross-sectional area before it is placed on said load, sensor means mounted to said frame positioned downstream from said high speed rollers, said sensor means sensing tension in the film as it is being carried by the load transported by the conveyor and controlling the speed of the motor means driving said roller means so that the speed of film leaving said high speed roller means is controlled to maintain a relatively constant tension on the film carried by the transported load, said constant tension being lower than said force, a pair of moveable clamping and sealing jaw assemblies mounted to said frame on opposite sides of said load path, each of jaw assemblies being adapted to engage a film portion of film from one said rotatable film roll and carry it toward each other into a position where the film portions are clamped together and positioned in a superimposed position, said jaw assemblies being provided with means for sealing said film portions together in at least two spaced apart sections, and means to sever said film portions between said sections forming a severed load wrap and the leading end of a wrap for the next load.

12. Apparatus as claimed in claim 11 including slacker means mounted to said frame, said slacker means comprising a roller member moveably mounted to said frame means, said moveable roller member being connected to cylinder means which when activated moves said moveable roller member to allow slack in said film web.

13. Apparatus as claimed in claim 11 wherein said sensor means comprises a roller assembly moveably mounted to said frame means, said roller assembly being connected to a sensor mechanism, said sensor mechanism ascertaining the tension in the web between said high speed roller means and the load transported along said conveyor.

14. Apparatus as claimed in claim 11 wherein said sensor mechanism is a strain gauge.

15. Apparatus as claimed in claim 11 wherein said sensor mechanism is a fluid damper.

16. Apparatus for wrapping a web of stretched plastic film around a load comprising conveyor means for transporting a load; said conveyor means providing a horizontal load path for the load; frame means positioned adjacent the horizontal load path, film web supply means for supplying a composite film web through said conveyor means and across the said load path, said conveyor means adapted to transport said load against the composite film web positioned across said load path so that the load carries the composite film web along said path, said film supply means comprising two rotatable film rolls which supply film webs, the leading ends of which are sealed together to form said composite film web for engagement with the leading side of the load, each rotatable film roll being associated with pre-stretching means to pre-stretch film dispensed from said film roll, said pre-stretching means comprising upstream and downstream roller means, said upstream roller means mounted downstream from said rotatable film roll and upstream from said downstream roller means, mechanical means connecting said upstream and downstream roller means, motor means connected to a roller of one of said upstream and downstream roller means to drive the roller so that film web from the rotatable film roll, when passed through said upstream and downstream roller means is stretched between said upstream and downstream roller means above the yield point of the film web before it is placed on said load, means to allow a portion of the film web to pass through said pre-stretching means in a state stretched less than its yield point, slacker means mounted to said frame means, said slacker means comprising a roller member moveably mounted to said frame means which tensions said film web, said moveable roller member being connected to cylinder means which when activated moves said moveable roller member to allow reduced tensioning in said film web, a pair of moveable clamping sealing jaw assemblies positioned on opposite sides of said load path, means to transport said jaw assemblies connected to said jaw assemblies, each of said jaw assemblies engaging portions of film web stretched less than its yield point, said jaw assemblies carrying said film web which has been stretched less than its yield point behind the load clamping said portions of the film webs together in superimposed position; said jaw assemblies including seal means for sealing said film webs together in at least two spaced apart sections and means to sever said sealed film webs between said at least two spaced apart sections to complete the wrap of the load.

17. The apparatus of claim 16 wherein film webs are positioned above and below said conveyor allowing said load to be wrapped around its front, top, rear and bottom sides.

18. A process for wrapping a web of stretched film material around a load carried by a conveyor with a pass through film wrapping apparatus comprising the steps of:

a. placing a composite film web comprising two film webs having their leading ends sealed together across the path of a transported load;
b. transporting said load ino said composite film web to engage said composite film web and carry said composite film web;
c. simultaneously pre-stretching each of the two film webs independently before the webs engage the load substantially beyond the film web's yield point by passing each said film web through pre-stretch means each comprising an upstream roller and a downstream roller driven at different relatively constant speeds to exert a force on the film webs so that the upstream roller retards each said film web with respect to said downstream roller;
d. relieving a portion of the force experienced by each of the film webs during pre-stretching after leaving said downstream rollers and while wrapping the film web around the load;
e. stopping the movement of the load along the conveyor path after it has passed the wrapping apparatus with the rear of the load positioned downstream of a pair of opposed sealing jaws;
f. moving said opposed sealing jaws inward toward each other against the film webs to superimpose the webs;
g. sealing the webs together in at least two places to form a composite web; and
h. cutting the webs between the spaced apart seals allowing a severed composite film web to hold the load under composite force.

19. The process of claim 18 wherein said film webs are linear low density polyethylene.

20. A process for wrapping a web of stretched film material around a load carried by a conveyor with a pass through film wrapping apparatus as claimed in claim 18 including the steps of:

feeding the pre-stretched film webs to the load at a relatively constant force, the speed of which is controlled by a sensor means; and
decreasing the force on the film webs in the seal area.

21. The process of claim 20 including the additional step after step (d) of interrupting the pre-stretch of the film webs while the portion of film web that is to be sealed passes through the pre-stretch mechanism.

22. A process for wrapping a web of stretched film material around a load carried by a conveyor with a pass through film wrapping apparatus comprising the steps of:

a. placing a composite film web comprising two film webs having their leading ends sealed together across the path of a transported load;
b. transporting said load into said composite film web to engage said composite film web and carry said composite film web;
c. simultaneously pre-stretching the two film webs independent of the pulling action of the load beyond the yield point of the film by passing each said web across an upstream roller and a downstream roller, said rollers being interconnected and driven to exert a prestretching force on the film webs so that each said web passes across said downstream roller faster than across said upstream roller;
d. feeding the pre-stretched film webs from said downstream rollers and around the load at a relatively constant force less than said prestretching force, the speed of which is controlled by a sensor means;
e. interrupting the pre-stretch of the film webs while continuing the feeding of the film webs to allow sections of film webs to pass through in a condition in which the film webs are stretched less than said yield point;

f. stopping the movement of the load along the conveyor path after it has passed the wrapping apparatus with the rear of the load positioned past a pair of opposed sealing jaws;

g. moving said opposed sealing jaws inward toward each other against said sections of film webs to superimpose the sections and clamp them together adjacent to the rear of the load;

h. sealing the sections together in at least two places to form at least two spaced apart seals; and i. cutting the web between the spaced apart seals.

* * * * *